US005256368A

United States Patent [19]

Oden et al.

[11] Patent Number: 5,256,368

[45] Date of Patent: Oct. 26, 1993

[54] PRESSURE-REACTION SYNTHESIS OF TITANIUM COMPOSITE MATERIALS

[75] Inventors: Laurance L. Oden; Thomas L. Ochs; Paul C. Turner, all of Albany, Oreg.

[73] Assignee: The United States of America as represented by the Secretary of the Interior, Washington, D.C.

[21] Appl. No.: 922,412

[22] Filed: Jul. 31, 1992

[51] Int. Cl.[5] ..... B22F 3/14

[52] U.S. Cl. ..... 419/10; 419/11; 419/12; 419/13; 419/14; 419/20; 419/39; 419/45; 419/48; 419/49

[58] Field of Search ..... 419/10, 11, 12, 13, 419/14, 19, 20, 39, 45, 48, 49

[56] References Cited

U.S. PATENT DOCUMENTS 4,820,393 4/1989 Brat et al. ..... 204/192.15
4,879,262 11/1989 Halverson et al. ..... 501/87
4,880,600 11/1989 Moskowitz et al. ..... 419/12
4,906,430 3/1990 Abkowitz et al. ..... 419/6
4,957,421 9/1990 Baldi ..... 419/8
4,968,348 11/1990 Abkowitz et al. ..... 75/244
4,973,355 11/1990 Takahashi et al. ..... 75/233
4,985,202 1/1991 Moshier et al. ..... 420/590
4,999,050 3/1991 Sanchez-Caldera et al. ..... 75/244
4,999,052 3/1991 Wilson ..... 75/338
5,034,282 7/1991 Hribernik et al. ..... 428/552
5,098,484 3/1992 Eylon et al. ..... 148/11.5 F
5,120,350 6/1992 Supan et al. ..... 75/232

*Primary Examiner*—Daniel D. Wasil
*Assistant Examiner*—Daniel Jenkins
*Attorney, Agent, or Firm*—E. Philip Koltos

[57] ABSTRACT

A pressure-reaction synthesis process for producing increased stiffness and improved strength-to-weight ratio titanium metal matrix composite materials comprising exothermically reacting a titanium powder or titanium powder alloys with non-metal powders or gas selected from the group consisting of C, B, N, BN, $B_4C$, SiC and $Si_3N_4$ at temperatures from about 900° to about 1300° C., for about 5 to about 30 minutes in a forming die under pressures of from about 1000 to 5000 psi.

15 Claims, 1 Drawing Sheet

PRESSURE-REACTION SYNTHESIS OF TITANIUM COMPOSITE MATERIALS

BACKGROUND OF THE INVENTION

1. Field of the Invention

The present invention relates to a pressure-reaction synthesis (PRS) process for forming titanium metal matrix composites by controlled chemical reaction of a mixture of metal and nonmetal powders under specific conditions of temperature within a forming die under specific conditions of pressure.

2. Background of the Invention

Titanium and its alloys are used in the construction of parts for machines and equipment because of their high strength and toughness, their excellent corrosion resistance and their low density; however, it is in the interest of the government and the citizens of the United States to provide titanium composite materials capable of providing the best available protection to personnel and equipment in all conditions where a threat to safety exists.

The manner of providing the best available protection to personnel and equipment would be to enhance protection per unit of thickness over existing conventional armor at a significant weight savings. Moreover, lighter personnel armor improves troop mobility and comfort, and weight reduction owing to lighter armor can result in a gross vehicle weight reduction of 2–10 times the actual weight decrease of the armor. Such a weight reduction significantly improves the operational economy of vehicles and increases the unit carrying capacity of transport vehicles, ships and aircraft.

In general, in the case of titanium or titanium alloy materials, the prior art teaches powder metallurgy technology for preparing metal matrix composites MMCs and laminated structures through the use of fine powders of an inert phase or phases (TiC, TiN, TiB and $TiB_2$) dispersed in Ti or Ti alloy powders. These powders are thoroughly mixed and consolidated into a green body by cold-compaction within a rigid die or by cold isostatic pressing within a flexible elastomer. The green body is densified by sintering and canning followed by hot isostatic pressing. Densification of the green body may also be accomplished by sintering to a state of non-connected porosity followed by hot isostatic pressing as is demonstrated in U.S. Pat. No. 4,731,115.

While powder metallurgy is a mature technology which often provides complicated shapes, efficient use of materials (near-net-shapes) and products with unique properties, one known limitation of the prior art is the lengthy time period at given temperatures that are necessary for densification by diffusion during sintering or hot isostatic pressing. For example, the required time and temperature are in the order of from about 1 to about 4 hours at from about 1150° C. to 1400° C. When the time at temperature is extended, composition leveling occurs, which is contamination of the matrix by diffusional interaction with the dispersed phase or phases. In the case of titanium or titanium alloy substrates coated with mixtures of metal, hard-metal or ceramic powders, which on sintering become metal matrix composites (MMCs), or laminated composites comprised of alternating layers of metallic substrates and MMCs, extended sintering results in weak bonding owing to the formation of brittle phases at the substrate interface and/or by contamination of the interface or both.

Further, extended sintering at high temperatures, as required in conventional powder metallurgical technology often results in recrystallization of the metal substrate accompanied by attendant degradation of mechanical properties.

Another limitation of the prior art in this area is the limited variety of dispersed phases that can be used in titanium metal matrix composites. As an example, the prior art is only applicable to dispersed phases that do not interact by diffusion or chemical reaction with titanium. A still further limitation of the prior art is the high pressures required for densification, and since pressure tends to improve densification, the prior art often operates at the pressure limit of the apparatus being used.

Accordingly, there is a need in powder metallurgy technology used for preparing metal matrix composites in laminated structures through the use of fine powders to develop processes requiring shorter times, lower temperatures and lower pressures in order to obtain titanium composite materials having properties heretofore unattainable using prior art techniques.

A further need exists in the art of preparing titanium composite materials to provide a pressure-reaction synthesis process which requires short reaction times of between about 5 to about 30 minutes in order to avoid excessive diffusional interaction (diffusional leveling) between components within a MMC or PRS bonding layer.

A yet further need exists in the art of preparing titanium composite materials to provide shorter reaction times to avoid excessive diffusional interaction between components within a MMC or PRS bonding layer, thereby increasing the fraction of dispersed phase within a composite without contaminating and embrittling the matrix material.

SUMMARY OF THE INVENTION

One object of the invention is to provide pressure. reaction synthesis of titanium composite materials by the application of in-situ chemical reactions to form metal matrix composites, laminated composites and coated structures.

Another object of the invention is to provide pressure-reaction synthesis of titanium composite materials whereby laminated composites and coatings can be prepared from metals whose reactivity precludes lamination and coating by conventional technologies such as welding and hot rolling.

These and other objects of the invention are accomplished by pressure-reaction synthesis of titanium composite materials, which is in essence, a process to form titanium metal matrix composites by controlled chemical reaction of a mixture of metal and nonmetal powders under specific conditions of temperature within a forming die under specific conditions of pressure. When the invention is applied to form a bonding layer between titanium or titanium alloy substrates, the invention process also obtains laminated composites. Moreover, coated substrates may be formed by a similar method if one of the substrates is removed following the pressure-reaction synthesis.

DETAILED DESCRIPTION OF THE INVENTION

Figure 1:
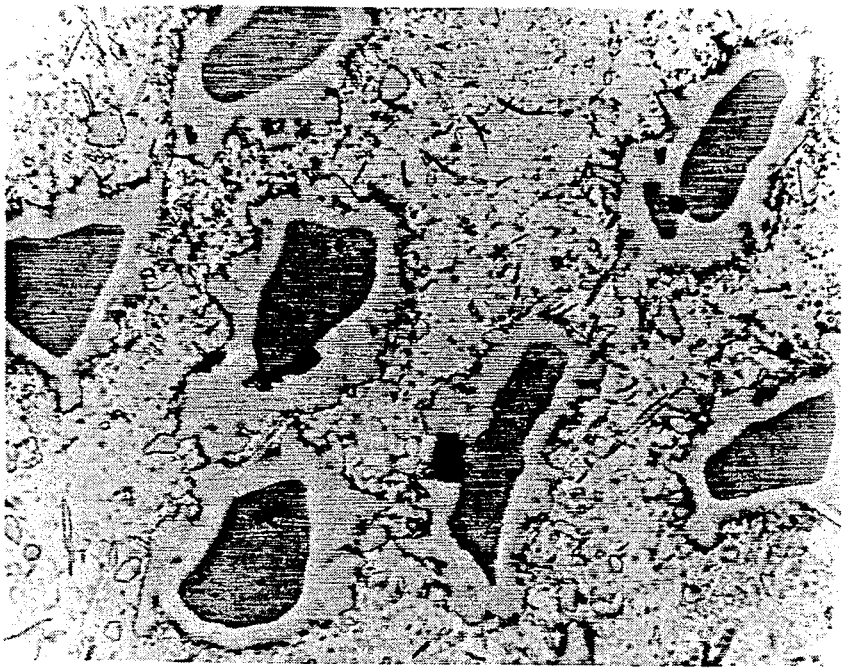
FIG. 1 is a titanium matrix composite (500X) wherein the darkest phase is unreacted $B_4C$, which is surrounded by a thick layer of TiB, which is in turn surrounded by a slightly darker thin layer of $Ti_2C$. The remaining continuous phase is fully-dense titanium.

The pressure-reaction synthesis (PRS) mixture of powders is a combination of materials selected to react exothermically or with a significant evolution of heat energy. The reaction or reactions may occur at positions of particle contact as in the case where one or more of the reactants are coarse particles, to produce high local temperatures that accelerate solid-state diffusion and/or result in melting of one or more of the phases.

The reaction or reactions can also occur over an advancing reaction front, as in the case where reactants are fine powders, and result in extensive melting. The latter case is commonly called self-sustaining high-temperature combustion synthesis (SHS). It will be recognized by those skilled in the art that particle size and the gradation of particle sizes are critical to: the packing density; the green strength of the unreacted mixture of powders; the extent of the PRS reaction or reactions; and the reaction rate. Consolidation of the PRS material to near theoretical density occurs in a very short time (1 to 10 minutes), at low global temperature ranges (900° to 1300° C.), and under conditions of light external pressure in the range 6.9 to 34.5 MPa (1000 to 5000 psi). In the case of laminated composites or coated substrates, the PRS material is effectively bonded to the substrate.

Because of the lower temperature of the process and short residence time at this temperature, there is no significant degradation of the physico-chemical properties of the metal, alloy, cermet, or ceramic substrates. The requisite external pressure and temperature can advantageously be obtained by hot pressing, hot isostatic pressing, hot rolling, or other means known to anyone skilled in the art.

In the case of laminated composites or coated substrates, the bonding or coating layer after undergoing the PRS reaction will have a mean thermal expansion coefficient which approximately matches that of the substrate for effective bonding to the substrate. PRS involving materials susceptible to chemical reaction with atmospheric gases is advantageously conducted in vacuo or within an atmosphere of inert gas.

The extent of the chemical reaction of components within the metal matrix composite or PRS bonding layer can be controlled by selection of the time and temperature to modify the composition and the properties of the dispersed phase and the metal matrix. For example, short-term interaction (5 to 30 minutes at 1200° C.) of 1 to 5 micrometer Ti powder with $B_4C$ particles that are coarse in relation to the Ti powder (44 to 500 micrometers) results in three-phase grains of dispersed phase within a ductile matrix of Ti. The dispersed phase comprises a thin outer shell of $Ti_2C$, a thicker inner shell of TiB, and a core of unreacted $B_4C$. The $Ti_2C$ and TiB function effectively to lock in the $B_2C$, thereby improving the mechanical properties and ballistic efficiency of the composite.

The invention generally is applicable to laminated metal, alloy, cermet, and ceramic composites for which compatible PRS reactions exist; however, the substrate and PRS bonding materials must be matched to achieve chemical and physical compatibility.

An appropriate PRS reaction for Ti and its alloys is given by equation 1, as follows:

$$6Ti + B_4C \rightarrow 4TiB + Ti_2C \qquad \text{Equation 1:}$$

The formulae for the products of the PRS reaction approximate the actual compositions observed. It is understood that the invention is broad in scope and is appropriate to the formation of MMCs, coated substrates, and laminated composites for the other reactive metals (Zr, Hf and their alloys) and the refractory metals (Cr, Mo, W, V, Nb, Ta and their alloys). Effective fuel materials include but are not limited to C, B, N, $B_4C$, BN, SiC, and $Si_3N_4$.

Extreme and preferred conditions for Ti MMCs are identical to the conditions for coated Ti substrates and the PRS bonding layer in laminated Ti composites. For laminated composites the preferred conditions are equal thickness of substrate and bonding layers for substrates and PRS bonding layers up to about 6.4 mm (0.25 inches), where the thickness of the bonding layer is the final thickness. A PRS bonding layer 6.4 mm thick supplies adequate energy to bond much thicker substrates; therefore, the upper limit to substrate thickness is not specified.

The invention is broad in scope and is not limited by the thickness of the substrate or bonding layers. Extreme and preferred conditions are given below for laminated composites prepared from Ti or Ti alloys and $B_4C$.

Composition Of The PRS Bonding Layer

Equation 1 is appropriate for the reaction of Ti and $B_4C$, where the formulae for the products of the reaction approximate the actual compositions of phases formed at the temperature of the PRS reaction. Ti and $B_4C$ are required in the ratio of 6 gm formula weights (moles) of Ti to 1 mole of $B_4C$. Additional Ti is advantageously added as a binder, which effectively bonds the hard metals together and bonds the PRS layer to the substrates. The extreme range of stoichiometry is 2.5 to 18 moles of Ti to one mole of $B_4C$. The preferred stoichiometry is 7.8 moles of Ti to 1 mole of $B_4C$.

Particle Size Of Ti and $B_4C$ Powders

The particle size of metal and nonmetal components of the PRS bonding layer determines the degree of completion of the PRS reaction and the reaction rate for constant conditions of time, temperature and pressure. Therefore, the physical and chemical properties of the MMC, coating, or bonding layer are significantly determined by the particle size of the reactant powders. While the preferred size of Ti powder is 1 to 5 micrometer (fine powder), a range of particle size for Ti from less than 1 micrometer to about 44 micrometer will suffice in the context of the invention.

The preferred size range of $B_4C$ powder is 44 micrometer to 500 micrometer. The 44 micrometer $B_4C$ powder is used for thin PRS layers (less than 1.5 mm). The larger particles of $B_4C$ are advantageously used in graded grit sizes for thicker PRS layers to increase the packing fraction. In all cases the use of $B_4C$ particles that are large in comparison with the Ti particles results in the formation of a reaction zone surrounding each coarse $B_4C$ particle, where the reaction zone comprises TiB and $Ti_2C$. The unreacted Ti powder effectively sinters or is melted by the heat of the PRS reaction to form a continuous ductile matrix surrounding the individual volumes of hard metal. The range of particle size in the context of the invention for $B_4C$ is from less than a micrometer to above 500 micrometer.

The preferred temperature for hot pressing MMCs, coated substrates, and laminated composites of Ti and its alloys and $B_4C$ is 1200° C.; however, a temperature range from about 900° C. to about 1300° C. will suffice in the context of the invention.

Preferred pressure for hot pressing metal matrix composites, coated substrates and laminated composites of Ti and its alloys and $B_4C$ is 17.2 MPa (2500 psi); however, a pressure range of between about 6.9 MPa (1000 psi) to about 34.5 MPa (5000 psi) will suffice in the context of the invention.

The preferred time for hot pressing metal matrix composites, coated substrates and laminated composites of Ti and $B_4C$ is about 10 minutes; however, within the context of the invention, 1 to 60 minutes will suffice.

Laminated Composite Examples

Laminated composites were prepared from Ti-6Al-4V substrates or substrates formed in-situ from 1 to 5 micrometer Ti powder and PRS bonding layers comprising 1 to 5 micrometer Ti metal powder and $B_4C$ powder in the particle size range 44 to 440 micrometer. Bonding layers less than 1.5 mm thick were prepared with 44 micrometer $B_4C$ powder. Thicker layers were prepared with 44 micrometer $B_4C$ powder and with graded particle sizes of $B_4C$.

Composition range: 3 to 13.1 moles Ti to 1 mole $B_4C$.

Top, bottom, and intermediate substrates: 41.3 mm (1 ⅝in) to 63.5 mm (2.5 in) diameter by 0.30 mm (0.012 in) to 6.35 mm (0.25 in) thick.

Bonding layer or layers: 0.30 mm (0.012 in) to 12.7 mm (0.50 in) thick.

Temperature range: 1000° C. to 1200° C.

Pressure range: 6.9 MPA (1000 psi) to 20.7 MPa (3000 psi).

Time at temperature: 5 to 30 minutes.

Method: Composites were prepared with 1 to 4 bonding layers. Composites with multiple layers contained an intermediate substrate of Ti-6Al-4V alloy sheet between layers of PRS material. Composites were heated in a graphite hot-press die within an atmosphere of argon to the reaction temperature, held for 5 to 30 minutes, and cooled by cutting furnace power.

As can be seen from the photomicrograph of FIG. 1 (magnification 500×) of a typical metal matrix composite prepared under the preferred conditions of the invention, the darkest phases is unreacted $B_4C$, which is surrounded by a thick layer of TiB, which in turn is surrounded by a slightly darker thin layer of individual particles of $Ti_2C$. The remaining continuous light-colored phase is fully dense titanium.

Figure 2:
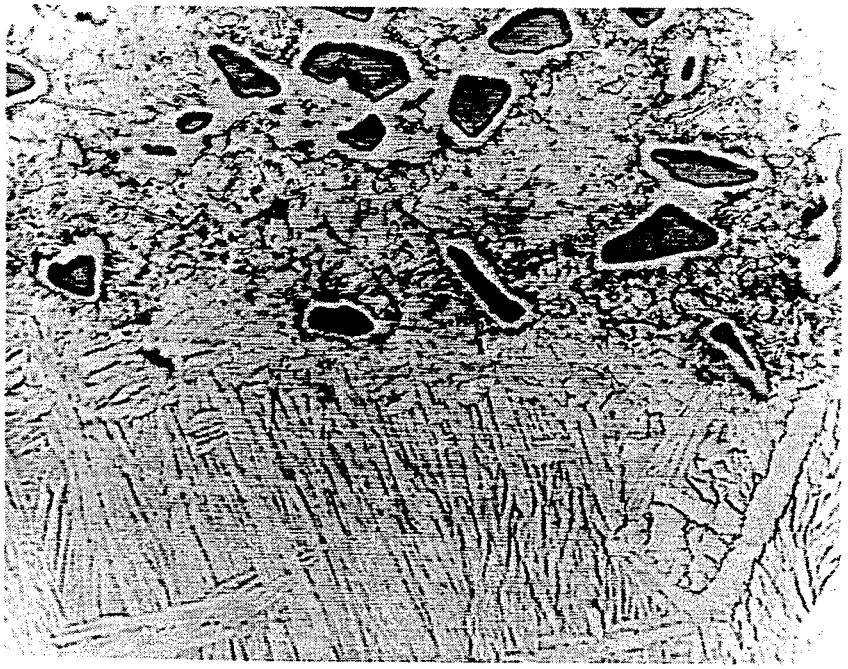
FIG. 2 shows the boundary between the titanium matrix composite in FIG. 1 and Ti.6Al-4V alloy substrate (200X) and illustrates the physical integrity of the bonding zone.

FIG. 2 is a photomicrograph (magnification 200×) of the boundary between the PRS layer and the Ti-6Al-4V alloy substrate. This figure illustrates the exceptional physical integrity of the bonding zone.

The foregoing embodiment of the invention according to equation 1 is not exhaustive, and alternative PRS reactions for Ti and its alloys in the context of the invention may be carried out in accordance with the following equations:

Equation 2: $xTi + C \rightarrow Ti_xC$, where x can vary from 1 to 2,

Equation 3: $Ti + yB \rightarrow TiB_y$, where y can vary from 1 to 2,)

Equation 4: $2Ti + + N_2 \rightarrow 2TiN$,

Equation 5: $(1 + y)Ti + yBN \rightarrow TiBy + yTiN$, where y can vary from 1 to 2, Equation 6: $8Ti + 3SiC \rightarrow Ti_5Si_3 + 3TiC$, and Equation 7: $9Ti + Si_3N_4 \rightarrow Ti_5Si_3 + 4TiN$.

Equivalent PRS reactions can be written by anyone skilled in the art for the other reactive metals of Zr and Hf and for the refractory metals Cr, Mo, W, V, Nb and Ta.

It is to be understood that the invention is broad in its scope and will therefore also apply to non-homogeneous composites wherein the substrates may be different, where the substrates and PRS layers may have different thicknesses, and where the PRS bonding layer or layers may contain metal powder or powders different from the substrates. Further, the invention will also be applicable to composition gradients or transition zones within the PRS bonding layer or layers to achieve chemical and physical compatibility with the substrate materials, and the transition zones of the changing composition can be used to change the composition from a ceramic bonding layer to metal or a cermet substrate.

In order to modify the physical properties, such as hardness, strength and toughness or to improve the ballistic coefficient, non-reactive materials may be added to the PRS mixture. The non-reactive materials may also be added to the PRS mixture as diluents or heat sinks to decrease the maximum temperature attained during the PRS reaction. These non-reactive materials include, but are not limited to, the refractory and thermodynamically stable carbides, borides, nitrides, silicides, and oxides such as TiC, ZrC, NbC, WC, $TiB_2$, SiC, TiN, $Si_3N_4$, $Al_2O_3$ and $Y_2O_3$.

Metal powders that are compatible with the substrate material and the PRS reactants may also be added to the PRS bonding layer in the capacity of a binder in and of themselves or upon reaction with one or more of the other components. Examples of metal powders which are effective binder additions for Ti and Ti alloy substrates include Ti, Ni and Mo, as well as other effective binder additions known to those skilled in the art to which the invention appertains.

The advantages of the invention over prior art processes is that the invention requires very short reaction times (generally between about 5 to about 30 minutes) and thereby avoids excessive diffusional interaction (diffusional leveling) between components within a MMC or PRS bonding layer. As a consequence, the fraction of dispersed phase within a composite may be increased without contaminating and embrittling the matrix material. Further, it is not known in the prior art to prepare laminated composites of the reactive metals in which the bonding layer has appreciable thickness and for which the bonding layer is well bonded to the substrate. Therefore, the process of the invention permits the preparation of MMCs having great latitude in terms of the number and composition of dispersed phases. The invention also permits the preparation of laminated composites having great latitude in terms of the thicknesses of substrates and PRS bonding layers.

When applied to composite armor, the invention permits the use of thinner sections for a given ballistic threat, and this translates into decreased body loads for personnel, decreased fuel consumption for motorized devices, and improved unit carrying capacity for transportation devices including land vehicles, ships and aircraft. Further still, the increased stiffness and strength-to-weight ratio of laminated composites provides greater freedom to the design engineer in devising a sufficient titanium composite material for a given purpose.

It will be apparent that the new and novel feature of the invention process is the application of in-situ chemical reactions to form metal matrix composites, laminated composites and coated structures. Laminated composites and coatings can be prepared from metals whose reactivity precludes lamination and coating by conventional technologies such as welding and hot rolling.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A pressure-reaction synthesis process for producing increased stiffness and improved strength-to-weight ratio titanium metal matrix composite materials comprising:

exothermically reacting a titanium powder or titanium powder alloys with non-metal powders or gas selected from the group consisting of C, B, N, BN, $B_4C$, SiC and $Si_3N_4$ at temperatures from about 900° to about 1300° C., for about 5 to about 30 minutes in a forming die under pressures of from about 1000 to 5000 psi.

2. The process of claim 1, wherein the reaction is conducted in vacuo.

3. The process of claim 1, wherein the reaction is conducted in an atmosphere of an inert gas.

4. The process of claim 1, wherein said pressures are obtained by hot pressing, hot isostatic pressing or hot rolling.

5. The process of claim 1, wherein the temperature is about 1;200° C., the titanium powder is of a size between about 1 to about 5 micrometers, the non-metal powder is $B_4C$ of a size between about 44 to about 500 micrometers, and the metal matrix is in three-phase grains of a dispersed phase within a ductile matrix of Ti; said dispersed phase comprising a thin outer shell of $Ti_2C$, a thicker inner shell relative to said outer shell of TiB, and a core of unreacted $B_4C$.

6. The process of claim 1, wherein the reaction proceeds in accordance with the equation:

$$6Ti+B_4C \rightarrow 4TiB+Ti_2C$$

7. The process of claim 1, wherein the reaction proceeds in accordance with the equation:

$$xTi+C \rightarrow Ti_xC, \text{ where x can vary from 1 to 2.}$$

8. The process of claim 1, wherein the reaction proceeds in accordance with the equation:

$$Ti+yB \rightarrow TiB_y, \text{ where y can vary from 1 to 2.}$$

9. The process of claim 1, wherein the reaction proceeds in accordance with the equation:

$$2Ti+N_2 \rightarrow 2TiN.$$

10. The process of claim 1, wherein the reaction proceeds in accordance with the equation:

$$(1+y)Ti+yBN \rightarrow TiB_y+yTiN, \text{ where y can vary from 1 to 2.}$$

11. The process of claim 1, wherein the reaction proceeds in accordance with the equation:

$$8Ti+3SiC \rightarrow Ti_5Si_3+3TiC.$$

12. The process of claim 1, wherein the reaction proceeds in accordance with the equation:

$$9Ti+Si_3N_4 \rightarrow Ti_5Si_3+4TiN.$$

13. A pressure-reaction synthesis process for producing increased stiffness and an improved strength-to-weight ratio titanium bonding layer to a substrate comprising:

exothermically reacting a titanium powder or titanium powder alloys with non-metal powders or gas selected from the group consisting of C, B, N, BN, $B_4C$, SiC and $Si_3N_4$ at temperatures from about 900° to about 1300° C., for about 5 to about 30 minutes in a forming die under pressures of from about 1000 to 5000 psi to form a layer; and bonding said layer onto a substrate having a mean thermal expansion coefficient which approximately matches that of the pressure-reaction synthesis layer.

14. A pressure-reaction synthesis process for producing increased stiffness and improved strength-to-weight ratio titanium coating to a substrate comprising:

exothermically reacting a titanium powder or titanium powder alloys with non-metal powders or gas selected from the group consisting of C, B, N, BN, $B_4C$, SiC and $Si_3N_4$ at temperatures from about 900° to about 1300° C., for about 5 to about 30 minutes in a forming die under pressures of from about 1000 to 5000 psi to form a bonding or coating layer; and coating layer onto a substrate having a mean thermal expansion coefficient which approximately matches that of the pressure-reaction synthesis coating.

15. A pressure-reaction synthesis process for producing increased stiffness and improved strength-to-weight ratio titanium laminated composite materials comprising:

exothermically reacting a titanium powder or titanium powder alloys with non-metal powders or gas selected from the group consisting of C, B, N, BN, $B_4C$, SiC and $Si_3N_4$ at temperatures from about 900° to about 1300° C., for about 5 to about 30 minutes in a forming die under pressures of from about 1000 to 5000 psi; and using the pressure-reaction synthesis product to laminate a substrate having a mean thermal expansion coefficient which approximately matches that of the laminate.

* * * * *